US008061559B1

(12) United States Patent
Chang

(10) Patent No.: US 8,061,559 B1
(45) Date of Patent: Nov. 22, 2011

(54) VENDING MACHINE HOUSING ASSEMBLY

(76) Inventor: Kil Jae Chang, Anyang (KR)

( * ) Notice: Subject to any disclaimer, the term of this patent is extended or adjusted under 35 U.S.C. 154(b) by 739 days.

(21) Appl. No.: 11/545,155

(22) Filed: Oct. 10, 2006

(51) Int. Cl.

| | |
|---|---|
| ***B65H 3/60*** | (2006.01) |
| ***G07F 11/00*** | (2006.01) |
| ***G07F 11/24*** | (2006.01) |
| ***A24F 15/04*** | (2006.01) |

(52) U.S. Cl. ..... 221/203; 221/24; 221/196; 221/195; 221/248; 221/155; 221/265; 221/282; 221/286; 221/285; 221/277; 194/350

(58) Field of Classification Search ..... 221/24, 221/196, 195, 203, 248, 155, 265, 282, 286, 221/285, 277; 194/350
See application file for complete search history.

(56) References Cited

U.S. PATENT DOCUMENTS

| | | | | |
|---|---|---|---|---|
| D103,055 | S | 2/1937 | Main | |
| 2,189,544 | A * | 2/1940 | Cramp | 221/186 |
| 2,537,317 | A | 1/1951 | Probasco | |
| 3,430,746 | A * | 3/1969 | Bolen | 194/255 |
| 3,804,294 | A * | 4/1974 | Householder | 221/154 |
| 4,534,492 | A * | 8/1985 | Schwarzli | 221/203 |
| 5,082,101 | A * | 1/1992 | Baker et al. | 194/350 |
| 5,131,519 | A * | 7/1992 | Ra | 194/350 |
| D331,603 | S | 12/1992 | Peterson | |
| 5,190,133 | A * | 3/1993 | Bolen | 194/350 |
| D344,762 | S * | 3/1994 | Peterson | D20/7 |
| 5,647,471 | A * | 7/1997 | Ra | 194/350 |
| 5,732,852 | A * | 3/1998 | Baker et al. | 221/116 |
| 5,833,117 | A * | 11/1998 | Kovens et al. | 221/24 |
| 6,857,710 | B2 | 2/2005 | Bolen | |
| D539,849 | S * | 4/2007 | Chang | D20/4 |

* cited by examiner

*Primary Examiner* — Gene O. Crawford
(74) *Attorney, Agent, or Firm* — John R. Flanagan

(57) ABSTRACT

A vending machine housing assembly includes a housing body having plural sides assembled one to the next in an end-to-end angular relationship so as to provide the housing body with a polygonal cross-sectional configuration. Each side define a wall portion and a corner portion in a one-piece construction in which the corner portion is rigidly and integrally connected to the wall portion and has an arcuate cross-sectional configuration determining the angular relationship between the sides of the housing body. The housing assembly also has an upper collar and a lower base respectively disposed above and below the housing body and having polygonal cross-sectional configurations like that of the housing body, and elements interconnecting and fixedly clamping the housing body between the upper collar and lower base to provide the housing assembly as a rigid construction.

10 Claims, 6 Drawing Sheets

VENDING MACHINE HOUSING ASSEMBLY

BACKGROUND OF THE INVENTION

1. Field of the Invention

The present invention generally relates to coin-operated vending machines and, more particularly, is concerned with a vending machine housing assembly.

2. Description of the Prior Art

A general type of prior art vending machine includes at least one merchandise storage and dispensing head, a housing supporting the one or more heads, a coin-actuated mechanism corresponding to each head and being mounted on and extending into the interior of the housing to where the coin-actuated mechanism operably engages the corresponding head, and at least one coin box disposed in the housing below the coin-actuated mechanisms for receiving coins from the operation of the coin-actuated mechanisms.

Some prior art vending machines have employed housings of varying constructions. In one example disclosed in U.S. Pat. No. 2,537,317 to Probasco, a vending machine has a housing which includes a rectangular base, a rectangular body having a one-piece construction supported upon the base, and a rectangular container mounting member supported upon the one-piece rectangular body. The base has a bottom and peripheral annular flange extending upwardly and receiving telescopically an annular bottom skirt of the base. The upper end of the body forms an external annular seat which receives and supports an annular flange of the container mounting member. The container mounting member, in turn, is formed with an internal seat which receives and supports the lower edge of a product-holding container. A coin controlled operating mechanism is detachably mounted to the one-piece body by being insertable into and removable from a top opening slot in the front wall of the one-piece body via grooves provided along side edges of a plate of the mechanism being slidably interfitted with opposite edges on the body wall defining the slot.

In another example disclosed in U.S. Pat. No. 4,534,492 to Schwarzli, the vending machine has a housing divided into an upper bin and a lower cashbox separated by an intermediate partition. The cashbox has a plurality of vertical structural members disposed upon and extending upright from a horizontal base. The cashbox also has lower wall portions secured in place by vertical slots in the vertical structural members and horizontal slots in the horizontal base. The partition overlies the lower wall portions. The vertical structural members have arcuate cross-sectional configurations and when assembled with the lower wall portions provide the corners of the cashbox. One of the lower wall portions is provided with an aperture into which is fitted an assembly comprising the product delivery chute. Bolts extend downwardly from the corners of the intermediate partition to the horizontal base and thus serve to clamp and secure together the vertical structural members and lower wall portions of the cashbox between the horizontal base and intermediate partition of the cashbox.

While these housing constructions of prior art vending machines may be more or less satisfactory, the inventor herein has perceived that there is a need for further innovation in housing construction which will enhance the assembly and durability of the general type of vending machine described above.

SUMMARY OF THE INVENTION

The present invention provides a coin-operated vending machine which incorporates a housing assembly designed to satisfy the aforementioned need. The vending machine housing assembly of the present invention has a construction which employs a minimum of parts and also provides four of such parts as sides of the housing assembly being of substantially identical configurations (except that two of the four sides have openings for enabling entry and withdrawl of a coin box) which should reduce the cost of production of the housing. The number of parts of the housing assembly are kept to a minimum by a unique approach underlying the present invention of forming each of the sides of the housing assembly to include, in a single- or one-piece construction, one of four side wall portions of the housing assembly with one of four corner portions of the housing assembly such that each of the corner portions is integrally connected with one of the side wall portions at a lateral end thereof.

Accordingly, the present invention is directed to a vending machine housing assembly which comprises: (a) a housing body having a plurality of sides assembled one to the next in an end-to-end angular relationship so as to provide the housing body in a polygonal cross-sectional configuration, each of the sides having a wall portion and a corner portion in a one-piece construction in which the wall portion and the corner portion are rigidly and integrally connected together, each of the corner portions having an arcuate cross-sectional configuration defining the angular relationship between the sides of said housing body; (b) an upper collar disposed above the housing body so as to overlie and seat upon the wall and corner portions of each of the sides of the housing body; (c) a lower base disposed below the housing body so as to underlie and have seated thereon the wall and corner portions of each of the sides of the housing portion; and (d) means for interconnecting and fixedly clamping the sides of the housing body between the upper collar and lower base so as to provide the housing assembly as a rigid construction in the polygonal cross-sectional configuration.

Furthermore, the means for interconnecting and fixedly clamping the sides of the housing body between the upper collar and the lower base includes a plurality of mateable elements of complementary shapes on the sides of the housing body and on the upper collar and lower base which enable mating and interconnecting of the housing body, upper collar and lower base together in a mated snug-fitting relationship. Also, the means for interconnecting and fixedly clamping the housing body between the upper collar and the lower base includes a plurality of elongated fasteners connecting and fixedly clamping the housing body between the upper collar and lower base so as to provide the rigid construction of the housing assembly.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 2:
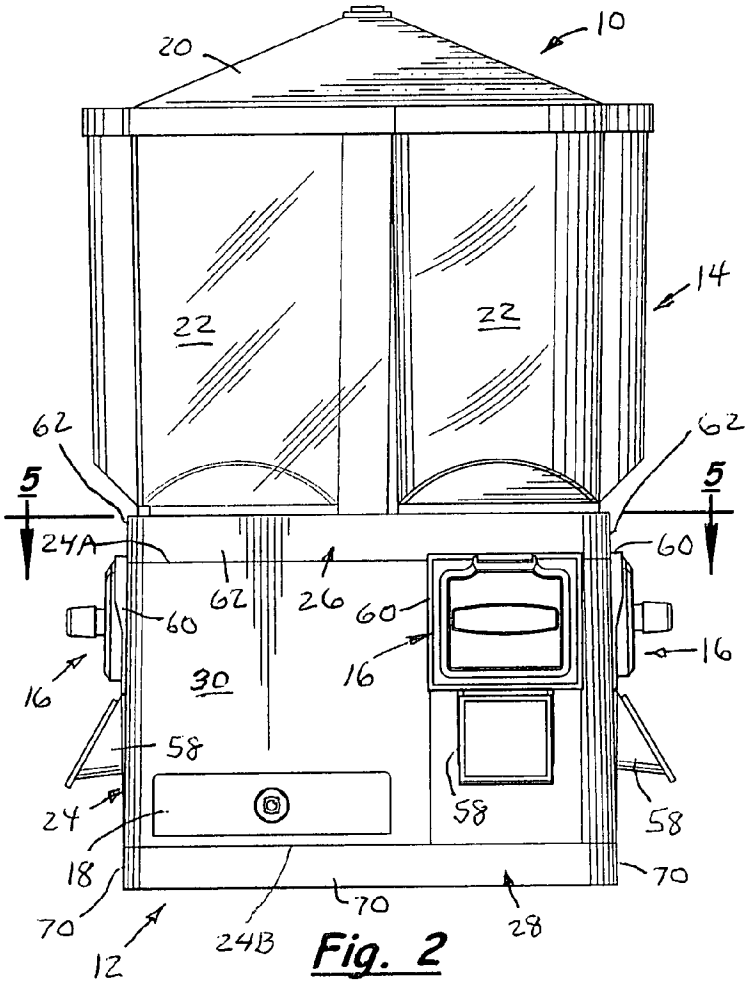
FIG. 2 is a side elevational view of the vending machine as seen along line 2-2 of FIG. 1.

Referring to the drawings and particularly to FIGS. 1-4, there are illustrated two embodiments of a coin-operated vending machine, generally designated 10 and 10A, which each includes a housing assembly 12 having a common construction. In addition to the housing assembly 12, each vending machine 10, 10A includes at least one and preferably four merchandise storage and dispensing heads 14, 14A supported by the housing assembly 12, at least one and preferably four coin-actuated mechanisms 16 mounted on and extending into the interior of the housing assembly 12 to where the coin-actuated mechanisms 16 operably engage corresponding ones of the respective heads 14, 14A, and at least one and preferably two coin boxes 18 supported by and disposed in the housing assembly 12 at levels below the coin-actuated mechanisms 16 for receiving coins from the operation of the coin-actuated mechanisms 16. The only major differences between the vending machines 10, 10A reside in two different configurations of their respective top covers 20, 20A which rest upon the heads 14, 14A and two different or configurations of the respective multiple canisters 22, 22A of their respective merchandise storage and dispensing heads 14, 14A.

Referring now to FIGS. 1-7, the vending machine housing assembly 12 basically includes a housing body 24, an upper collar 26 and a lower base 28. The housing body 26 includes a plurality of sides 30, preferably but not necessarily four in number and being substantially identical to one another, which are assembled one to the next in an end-to-end angular relationship so as to provide a polygonal, preferably a rectangular, cross-sectional configuration for the housing body 24. Each side 30 is composed of a wall portion 32, being of relatively flat configuration, and corner portion 34, being of relatively curved or arcuate configuration. The wall portion 32 and corner portion 34 are made of any suitable material such as a plastic of metal and formed or manufactured in any suitable manner as a one-piece construction in which the corner portion 34 is rigidly and integrally connected to the wall portion 32. Thus, the corner portions 34 are equal in number to the wall portions 32 and have substantially arcuate cross-sectional configurations such that the corner portion 34 of each side 30 projects beyond a plane defined by the flat configuration of the wall portion 32 of the corresponding side 30 and thereby determines the angular relationship between the sides 30 of the housing body 24. The upper collar 26 and lower base 28 of the housing assembly 12 are respectively disposed above and below the housing body 24 and each has a polygonal, preferably rectangular, cross-sectional configuration substantially identical to that of the housing body 24. The upper collar 26 overlies and seats upon the wall and corner portions 32, 34 of each side 30, and the lower base 28 underlies and has seated thereon the wall and corner portions 32, 34 of each side 30.

Referring now to FIGS. 6-15, the housing assembly 12 also includes means in the form of a plurality of elements, generally designated 36, for fastening, interconnecting and clamping the separate sides 30 of the assembled housing body 24 between the upper collar 26 and lower base 28 so as to provide the housing assembly 12 in a substantially rigid construction and in the desired polygonal cross-sectional configuration. The plurality of elements 36 includes a plurality of mateable elements 38 of complementary configurations on the sides 30 of the housing body 24 and on the upper collar 26 and lower base 28 which mate together and thereby enable interconnecting and clamping together of the assembled housing body 24, upper collar 26 and lower base 28 in a mated snug-fitting relationship. The plurality of elements 36 also includes a plurality of elongated members 40, such as conventional fasteners or bolts, each located separate from but adjacent to one of the corner portions 34 of the separate sides 30 of the assembled housing body 26, extending between, interconnecting and detachably fastening the upper collar 26 with the lower base 28 so as to clamp the assembled housing body 24 therebetween and in the substantially rigid construction but nevertheless disassembliable into the physically separate sides 30 by detaching the elongated members 40 from the upper collar 26 and lower base 28.

Referring to FIGS. 6 and 11-15, more particularly, the sides 30 of the housing body 24 each has opposite top and bottom edges 42, 44 and first and second lateral ends 46, 48 and together form an interior chamber 50 through the housing body 24 being open at top and bottom ends 24A, 24B thereof defined by the top and bottom edges 42, 44 of the sides 30. Furthermore, the sides 30 preferably, although not necessarily, are substantially identical to one another, except for the presence of a rectangular opening 52 in two of the sides 30 for accommodating the entry and removal of the coin boxes 18, 18A. The corner portions 34 are located at the first lateral ends 46 of the respective sides 30 of the housing body 24. In addition, each of the sides 30 also having a cutout region 54 provided within the wall portion 32 thereof being defined by an interior edge 56 on the wall portion 32 extending inwardly from the second lateral end 40 and top edge 42 and spaced above the bottom edge 44 of the respective side 30 so as to form an opening 57 through the respective side 30 of the housing body 24 adapted to receive and removably support a discharge chute structure 58 and a coin-operated actuation mechanism mounting structure 60 of the vending machine 10, 10A such that at the interior edge 56 on the wall portion 32 of each one side 30 and the corner portion 34 on each another side 30 adjacent to the each one side 30 the housing body 24 is adapted to support one of the plurality of discharge chute structures 58 and coin-operated actuation mechanism mounting structures 60 so that such structures 58, 60 substantially complete the wall portions 32 by closing the openings 57 through the sides 30 of the housing body 24, as seen in FIGS. 1-4.

Referring to FIGS. 5-8, the upper collar 26, made of a suitable plastic or metal material, is disposed above the housing body 24 and has a plurality of wall segments 62 rigidly connected one to the next in an end-to-end angular relationship the same as that of the sides 30 as provided by the corner portions 34 so that the upper collar 26 is provided with a rigid polygonal, preferably rectangular, configuration substantially identical to that of the housing body 24. Each of the wall segments 62 of the upper collar 26 has lower edges 64 positioned above and adjacent to the top edges 42 of the sides 30 of the housing body 24 such that adjacent exterior surfaces 62A, 30A defined on the wall segments 62 of the upper collar 26 and on the sides 30 of the housing body 24 are substantially coplanar with one another. The upper collar 26 also has a reinforcing framework 66 which extends between and rigidly interconnects the wall segments 62 and defines openings 68 through the upper collar 26 communicating with the interior chamber 50 of the housing body 24 such that the openings 68 and the framework 66 respectively can receive and support dispensing heads 14, 14A of the vending machine 10, 10A.

Figure 6:
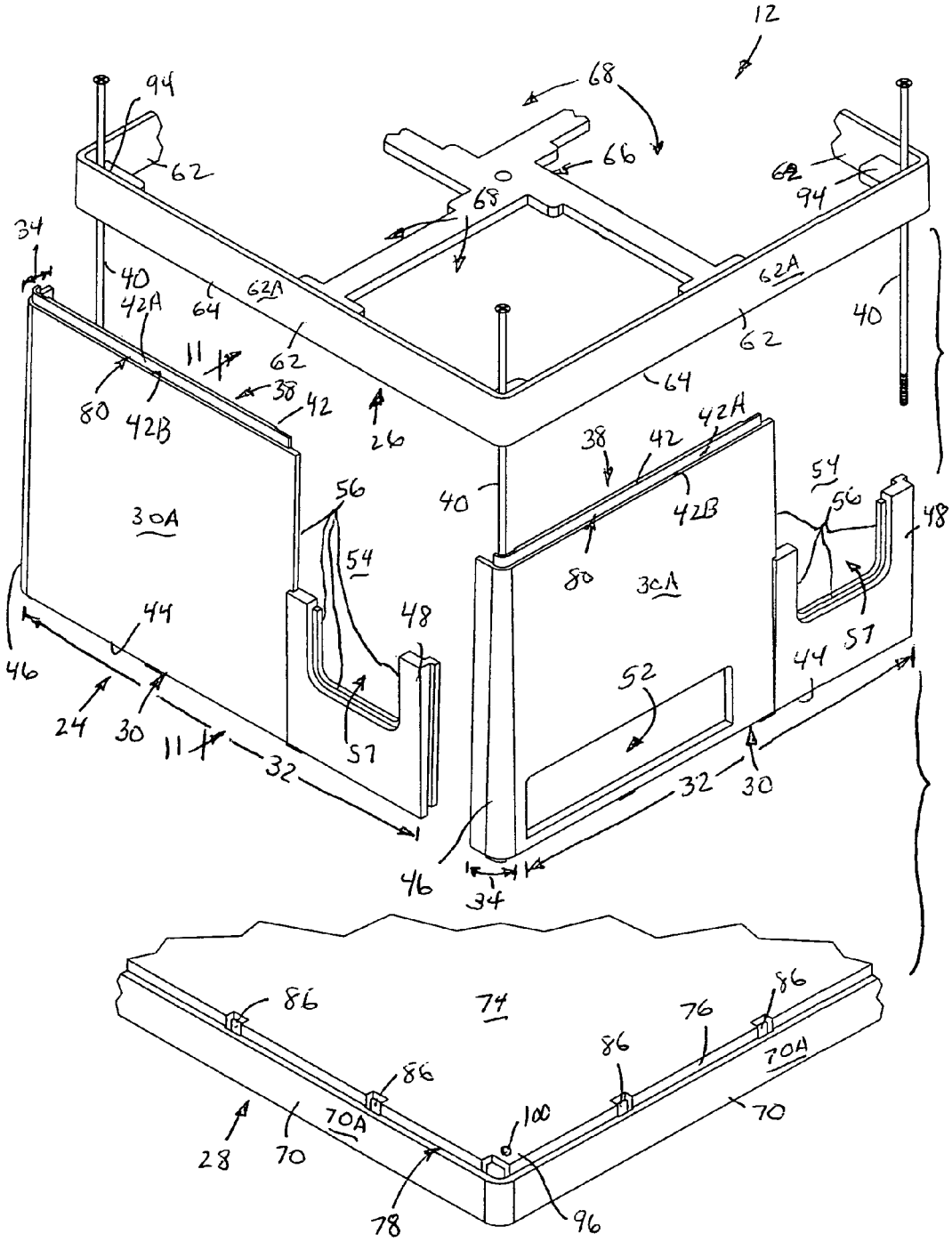
FIG. 6 is an exploded fragmentary view of the housing assembly of FIG. 5.
Figure 7:
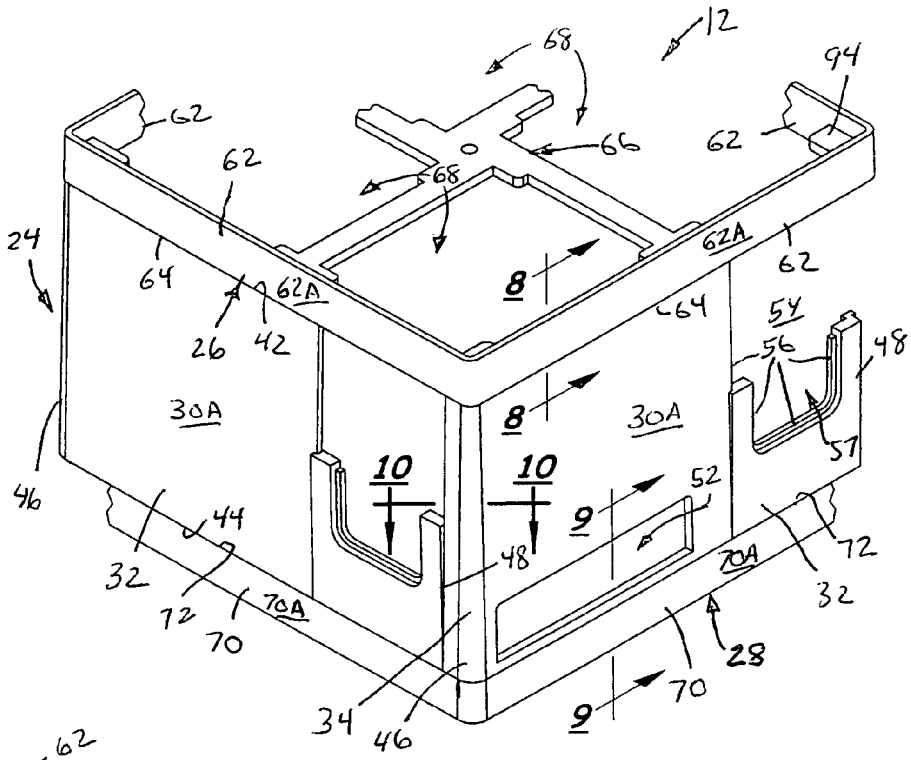
FIG. 7 is an assembled fragmentary view of the housing assembly of FIG. 6.
Figure 8:
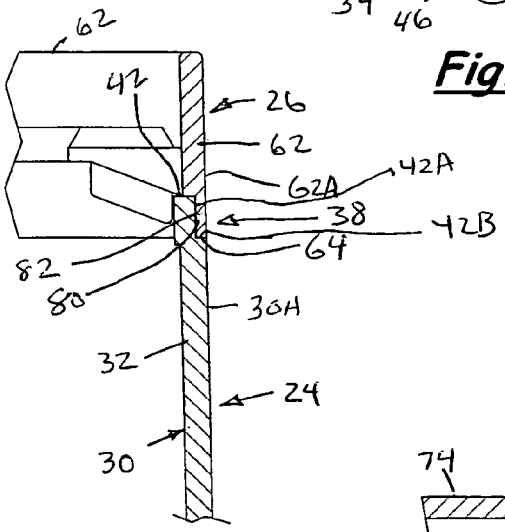
FIG. 8 is an enlarged fragmentary sectional view taken along line 8-8 of FIG. 7, showing an interfitted relationship of mateable elements on the upper collar and one of the sides of the housing body of the housing assembly.
Figure 9:
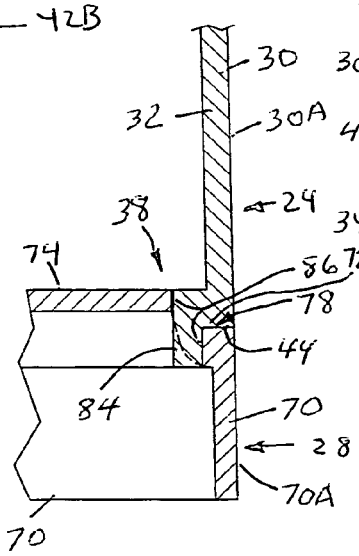
FIG. 9 is another enlarged fragmentary sectional view taken along line 9-9 of FIG. 7, showing an interfitted relationship between mateable elements on the lower base and one of the sides of the housing body of the housing assembly.
Figure 10:
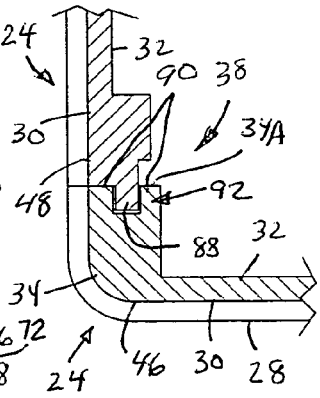
FIG. 10 is a further enlarged fragmentary sectional view taken along line 10-10 of FIG. 7, showing an interfitted relationship between mateable elements on the corner portion of one of the sides of the housing body and the wall portion of another of the sides of the housing body adjacent to the one side.
Figures 11, 12, 13, 14, 15:
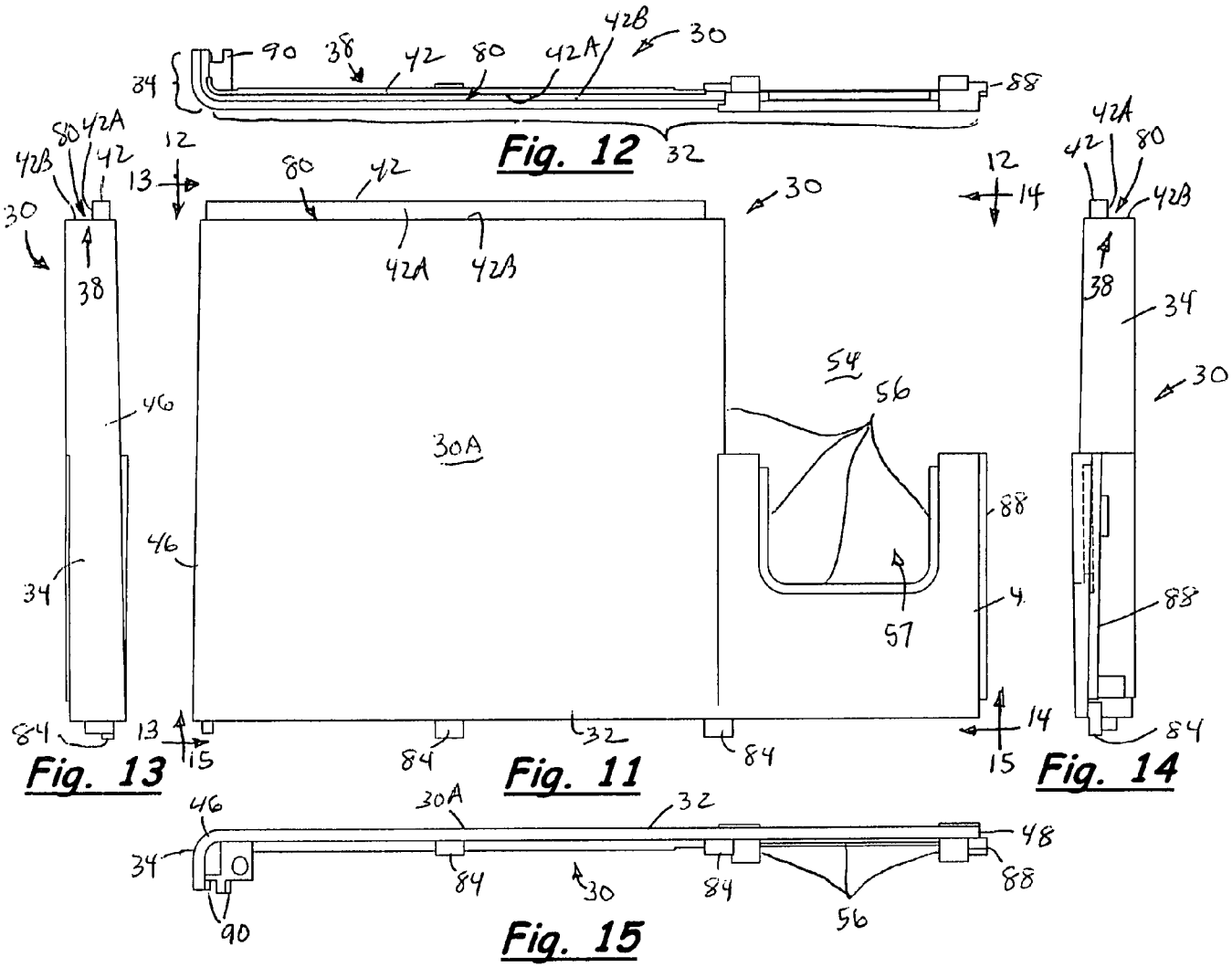
FIG. 11 is an enlarged front elevational view of one of the sides of the housing body as seen along line 11-11 of FIG. 6.
FIG. 12 is a top end view of the one housing body side as seen along line 12-12 of FIG. 11.
FIG. 13 is a left end view of the one housing body side as seen along line 13-13 of FIG. 11.
FIG. 14 is a right end view of the one housing body side as seen along line 14-14 of FIG. 11.
FIG. 15 is a bottom end view of the one housing body side as seen along line 15-15 of FIG. 11.

Referring to FIGS. 6, 7 and 9, the lower base 28, also made of a suitable plastic or metal material, is disposed below the housing body 24 and has a plurality of wall sections 70 rigidly connected to one to the next in an end-to-end angular relationship so as to provide the lower base 28 with a rigid polygonal, preferably rectangular, configuration substantially identical to that of the housing body 24 and upper collar 26. Each wall section 70 of the lower base 28 has upper edges 72 positioned below and adjacent to the bottom edges 44 of the sides 30 of the housing body 24. The lower base 28 also has a platform 74, generally flat in shape, disposed within and extending between and rigidly connected to the wall sections 70 such that a peripheral edge 76 of the platform 74 is disposed adjacent to the upper edges 72 of the wall sections 70 so as to define therewith an outer peripheral recess 78 on the lower base 28 adapted to seat therein the bottom edges 44 of the sides 30 of the housing body 24 such that adjacent exterior surfaces 70A, 30A on defined on the wall sections 70 of the lower base 28 and on the sides 30 of the housing body 24 are substantially coplanar with one another.

Referring to FIGS. 5-14, the elements 38 are formed on the top and bottom edges 42, 44 and first and second lateral ends 46, 48 of the sides 30 of the housing body, on the upper collar 26 and on the lower base 28 adjacent to the outer peripheral recess 78 thereon. The complementary mateable configurations of these elements 38 enable the assembling together of the housing body 24, upper collar 26 and lower base 28 in a snugly or tightly fitting relationship so as to provide the housing assembly 12 with the substantially rigid construction for the vending machine 10, 10A. As best seen in FIGS. 5, 6, 8 and 11-15, a first combination of the complementary mateable elements 38 includes recesses 80, 82 respectively defined along inner and outer faces 42A, 42B of the top edges 42 of the sides 30 of the housing body 24 and along lower edges 64 of the wall sections 62 of the upper collar 26 which allow interfitting thereof together in a snug side-by-side relationship. As best seen in FIGS. 6, 7, 9, 11 and 13-15, a second combination of the complementary mateable elements 38 includes lugs 84 spaced apart from one another and rigidly attached on and projecting downwardly from bottom edges 44 of the sides 30 of the housing body 24 and slots 86 having shapes complementary to that of the lugs 84 and being defined in the lower base 28 adjacent to the outer peripheral recess 78 thereon which adapt the lugs 84 to tightly interfit in the slots 86. As best seen in FIGS. 6, 7, 10, 12 and 15, a third combination of the complementary mateable elements 38 are first and second rigid strips 88, 90 attached on the first and second lateral ends 46, 48 of the sides 30 of the housing body 24 so as to define tightly interfitting tongue and groove connections 92 along one vertical edge 34A of the corner portions 34 between the first and second lateral ends 46, 48 of the sides 30 of the housing body 24.

Figure 1:
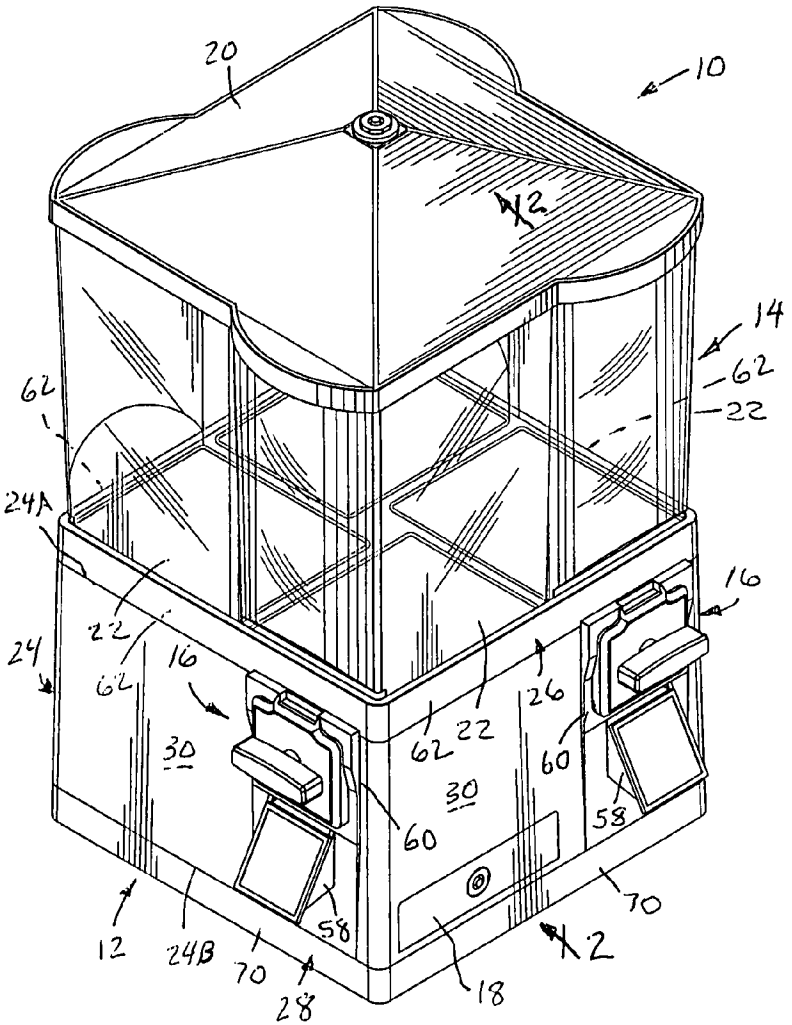
FIG. 1 is a perspective view of one embodiment of a coin-operated vending machine employing a common housing assembly of the present invention.
Figure 4:
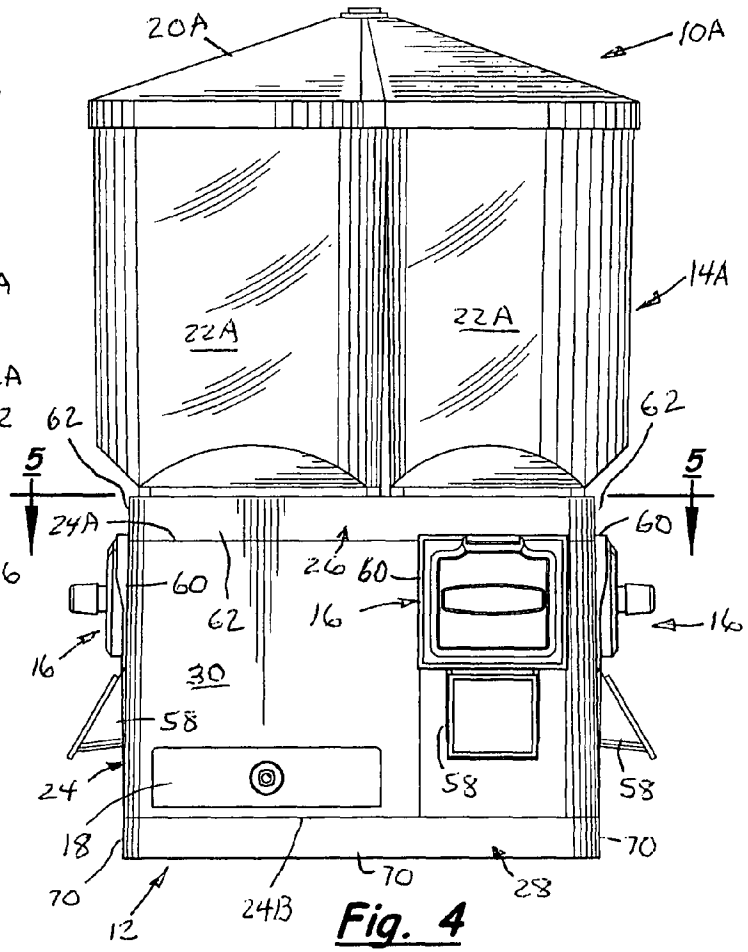
FIG. 4 is a side elevational view of the vending machine as seen along line 4-4 of FIG. 3.
Figure 3:
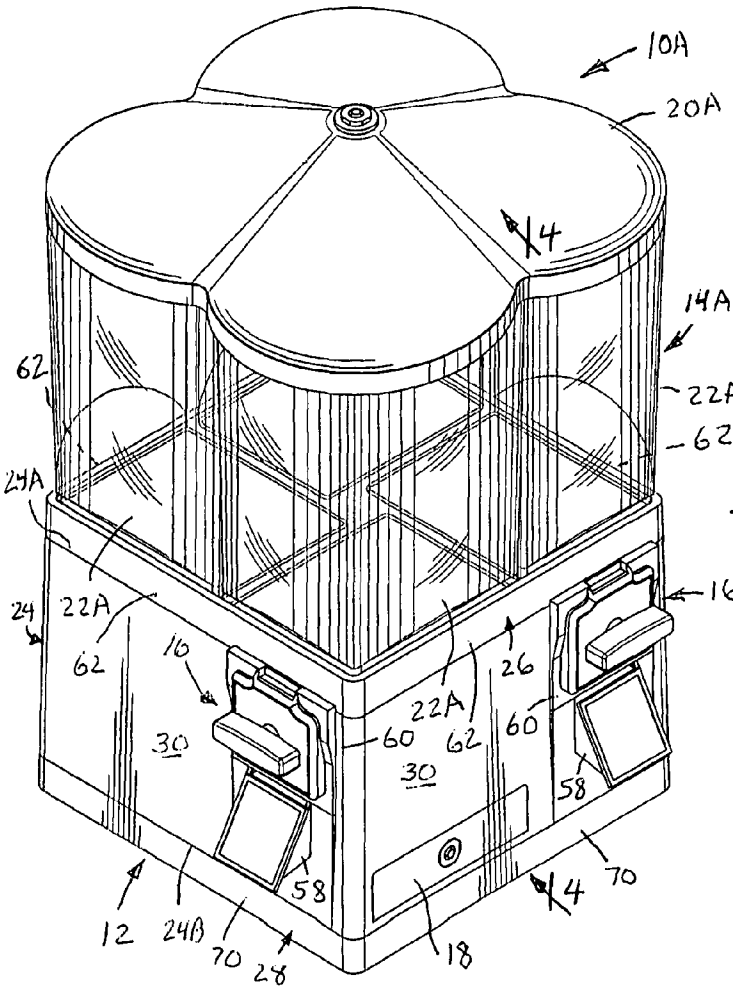
FIG. 3 is a perspective view of another embodiment of a coin-operated vending machine employing the common housing assembly of the present invention.
Figure 5:
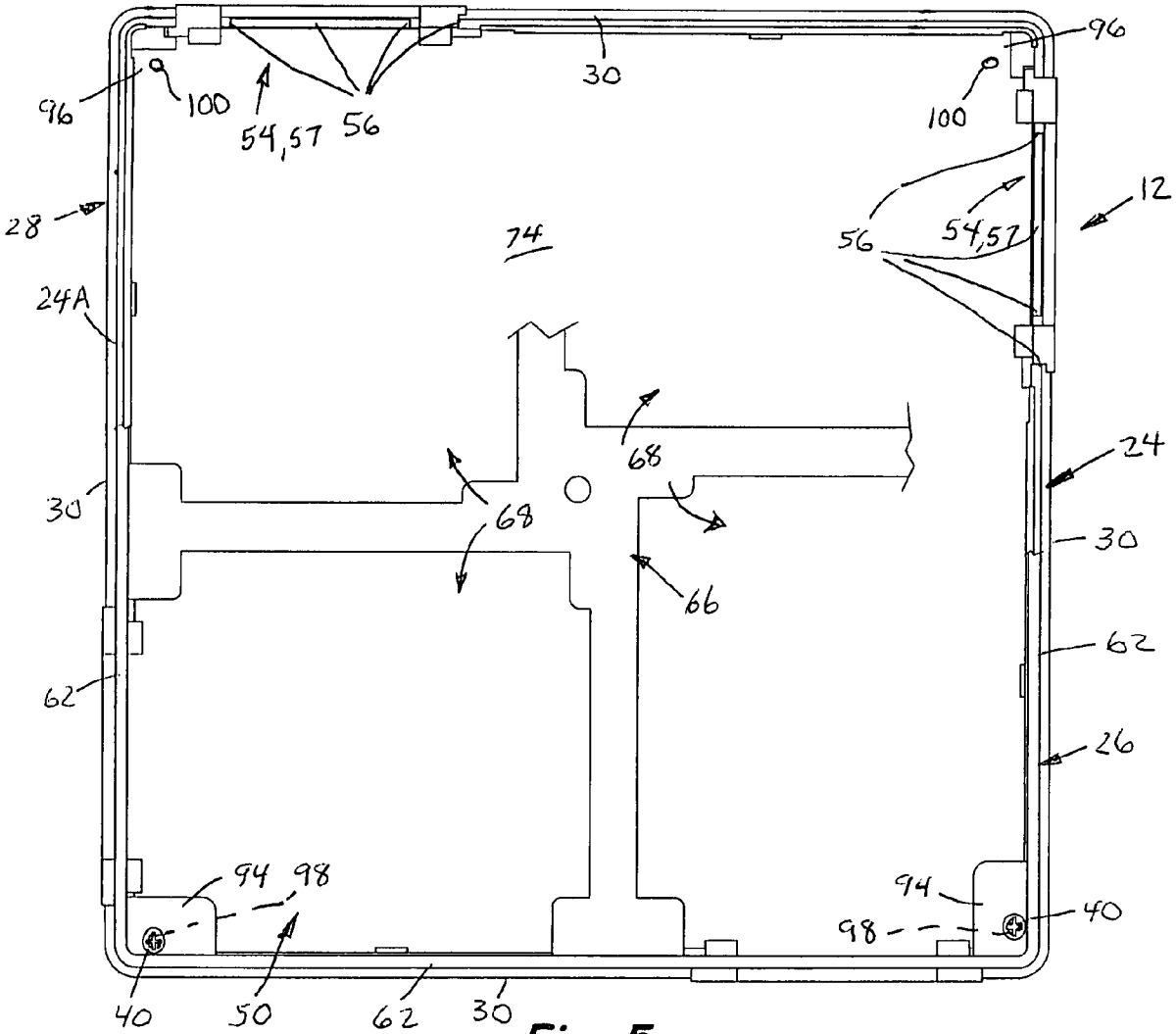
FIG. 5 is an enlarged top plan view of the housing assembly as seen along line 5-5 either of FIG. 1 or FIG. 3, with slightly less than one-half of an upper collar of the housing assembly being broken away and omitted.

Furthermore, in addition to the elongated fasteners 40, the above-mentioned means 36 for rigidly clamping the housing body 24 between the upper collar 26 and the lower base 28 to retain the desired polygonal configuration of the housing body 24, includes a plurality of sites 94, 96 on the upper collar 26 and lower base 28 that receive the fasteners 40. The sites 94 in the upper collar 26 have holes 98 through which the fasteners 40 pass whereas the sites 96 in the lower base 28 have threaded holes 100 tapped therein which threadably receive and secure the fasteners 40 to the lower base 28 such that the fasteners 40 when tightened and secured, such as by use of a conventional screwdriver, to the upper collar 26 and lower base 28 rigidly clamps the sides 30 of the housing body 24 therebetween in the polygonal configuration. An elongated assembly rod (not shown), as conventionally well-known, can be attached at a lower end to the lower base 28 and extend upwardly through the housing body 24, the dispensing head 14, 14A and top cap 20, 20A of the vending machine 10, 10A to an upper end which by operation of a lock mechanism 102 (as seen in FIGS. 1 and 3) can be secured to the top cap 20, 20A for assembling and clamping the dispensing head 14, 14A and its multiple canisters 22, 22A between the top cap 20, 20A and the housing assembly 12.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A vending machine housing assembly, comprising:

(a) a plurality of physically separate sides adapted to be assembled together one to the next in an end-to-end angular relationship so as to provide an assembled housing body with a polygonal cross-sectional configuration, at least one of said separate sides being adapted for supporting a coin-operated actuation mechanism mounting structure of a vending machine, each of said separate sides having a wall portion and a corner portion formed as a one-piece construction in which said wall portion and said corner portion are rigidly and integrally connected together, each of said separate sides having opposite spaced apart top and bottom edges correspondingly defining open top and bottom ends of said assembled housing body when said separate sides are assembled together, each of said separate sides also having a pair of opposite spaced apart lateral ends with said corner portion of each separate side being disposed at and defining only one of said lateral ends, said wall portions each having a flat configuration and said corner portions each having an arcuate cross-sectional configuration such that said corner portion of each side projects beyond a plane defined by said flat configuration of said wall portion of the corresponding side and thereby determines said angular relationship between said separate sides of said assembled housing body;

(b) an upper collar adapted for supporting at least one dispensing head of a vending machine above said upper collar, said upper collar disposed above said assembled housing body so as to overlie and seat upon said wall and corner portions of each of said separate sides at said top edge thereof and thus overlie and seat upon said assembled housing body at said top end thereof;

(c) a lower base disposed below said assembled housing body so as to underlie and have seated thereon said wall and corner portions of each of said separate sides at said bottom edge thereof and thus said assembled housing body at said bottom end thereof; and (d) a plurality of elements including a plurality of elongated members each located separate from but adjacent to one of said corner portions of said separate sides of said assembled housing body, extending between and detachably fastening and thus interconnecting said upper collar and lower base together so as to clamp said separate sides of said assembled housing body at said respective top and bottom ends thereof between said upper collar and lower base and thereby provide said assembled housing assembly in a substantially rigid construction but nevertheless disassembliable into said physically separate sides by detaching said elongated members from said upper collar and lower base;

(e) wherein at least one of said wall portions of said sides has a cutout region defined on said wall portion starting at and extending inwardly from the other of said lateral ends and said top edge and spaced inwardly from said bottom edge of said side so as to form an opening through said side of said housing body adapted to receive a discharge chute structure and said coin-operated actuation mechanism mounting structure of the vending machine such that at said cutout region on said wall portion at said other lateral end of said side and an edge of said corner portion on said one lateral end of said side adjacent thereto said assembled housing body is adapted to support the discharge chute structure and coin-operated actuation mechanism mounting structure so that such structures substantially complete said wall portion at said one lateral end of said side by closing said opening therethrough.

2. The housing assembly of claim 1 wherein said upper collar includes:

a plurality of wall segments rigidly connected one to the next in an end-to-end angular relationship so as to provide said upper collar with said polygonal cross-sectional configuration substantially identical to that of said assembled housing body; and a reinforcing framework extending between and rigidly interconnecting said wall segments and defining openings through said upper collar communicating with an interior of said assembled housing body therebelow such that said openings and said framework respectively can receive and support a plurality of said dispensing heads of the vending machine thereabove.

3. The housing assembly of claim 1 wherein all of said wall portions of said sides of said housing body have said cutout regions defined therein.

4. The housing assembly of claim 1 wherein said upper collar includes a plurality of wall segments rigidly connected one to the next in an end-to-end angular relationship so as to provide said upper collar with a polygonal cross-sectional configuration substantially identical to that of said assembled housing body, each of said wall segments of said upper collar having lower edges positioned above and adjacent to said top edges of said sides of said assembled housing body such that adjacent exterior surfaces on said wall segments of said upper collar and said sides of said assembled housing body are disposed substantially coplanar with one another.

5. The housing assembly of claim 1, wherein said plurality of elements includes a plurality of mateable elements of complementary configurations defined on and extending along said top and bottom edges of said separate sides of said assembled housing body and on said upper collar and said lower base which mate together and thereby enable interfitting together of said assembled housing body, upper collar and lower base in a mated relationship.

6. The housing assembly of claim 1 wherein said elongated members interconnecting said upper collar and lower base and clamping said separate sides of said assembled housing body between said upper collar and lower base includes a plurality of fasteners and a plurality of sites on said upper collar and said lower base respectively having aligned pairs of through holes and threaded holes therein for receiving and securing said fasteners such that said fasteners when secured to said upper collar and lower base connect and clamp said separate sides of said assembled housing body between said upper collar and lower base so as to provide said substantially rigid construction of said housing assembly in said polygonal cross-sectional configuration.

7. The housing assembly of claim 5 wherein:

said upper collar has lower edges positioned above and adjacent to said top edges of said separate sides of said assembled housing body; and said mateable elements include recesses formed along said top edges of said separate sides and said lower edges of said upper collar which allow interfitting of said top edges of said separate sides and lower edges of said upper collar together side-by-side in said mated relationship.

8. The housing assembly of claim 7 wherein said mateable elements also include first and second rigid strips attached on said lateral ends of said sides of said housing body so as to define interfitting tongue and groove connections between said lateral ends of said separate sides of said assembled housing body.

9. The housing assembly of claim 7 wherein said lower base includes:

a plurality of wall sections rigidly connected one to the next in an end-to-end angular relationship so as to provide said lower base with said polygonal cross-sectional configuration, each of said wall sections of said lower base having upper edges positioned below and adjacent to said bottom edges of said separate sides of said assembled housing body; and a platform extending between and rigidly connected to said wall sections such that a peripheral edge of said platform is disposed adjacent to said upper edges of said wall sections so as to define therewith an outer peripheral recess on said lower base adapted to seat therein said bottom edges of said separate sides of said assembled housing body such that adjacent exterior surfaces on said wall sections of said lower base and on said separate sides of said assembled housing body are substantially coplanar with one another.

10. The housing assembly of claim 9 wherein said mateable elements further include:

a plurality of lugs spaced apart from one another and rigidly attached on and projecting downwardly from said bottom edges of said separate sides of said assembled housing body; and a plurality of slots having shapes complementary to that of said lugs being defined in said lower base adjacent to said outer peripheral recess on said lower base which adapts said lugs to mate and interfit in said slots.

* * * * *